United States Patent [19]

Honegger

[11] 4,021,984

[45] May 10, 1977

[54] SECTIONAL EDGE STRIP

[76] Inventor: Heinz Honegger, Lochmuhle, Rorbas, Switzerland, CH8427

[22] Filed: Oct. 8, 1975

[21] Appl. No.: 620,646

[30] Foreign Application Priority Data

Oct. 19, 1974 Switzerland ..... 13996/74

[52] U.S. Cl. ..... 52/471; 52/396; 52/699; 249/194

[51] Int. Cl.[2] ..... E04C 1/34

[58] Field of Search ..... 52/471, 403, 396, 699, 52/704, 707, 710; 404/67, 68, 48; 249/194, 219 R; 264/275

[56] References Cited

UNITED STATES PATENTS

| | | | |
|---|---|---|---|
| 152,892 | 7/1874 | Anthony | 52/471 |
| 747,120 | 12/1903 | Beaumont | 52/471 |
| 3,156,450 | 11/1964 | Thom | 52/710 |
| 3,594,028 | 7/1971 | Scott | 52/471 |
| 3,750,359 | 8/1973 | Balzer | 404/67 |
| 3,848,379 | 11/1974 | Hazen | 52/403 |

FOREIGN PATENTS OR APPLICATIONS

| | | | |
|---|---|---|---|
| 1,328,699 | 8/1973 | United Kingdom | 52/471 |

*Primary Examiner*—Ernest R. Purser
*Assistant Examiner*—Henry Raduazo
*Attorney, Agent, or Firm*—Thomas W. Speckman

[57] ABSTRACT

A sectional edge strip for casting integrally with a concrete shape having a groove adapted to hold the edge of elastic jointing strip and grooves extending along the entire length of the sectional edge strip whereby fixing screws can be fitted at freely selected points fastening the strip to the mold for the concrete.

10 Claims, 3 Drawing Figures

SECTIONAL EDGE STRIP

This invention relates to a sectional edge strip intended for casting integrally with a concrete shape, having a groove adapted to take the edge of an elastic jointing strip. It is important that a sectional strip of the type, as fixed, for example, along the edge of prefabricated concrete shapes, is held in the correct position inside the mold during the production of the precast concrete shape.

It is an object of the present invention to provide a simple and inexpensive solution to this problem.

The sectional edge strip according to the invention is characterized by having on at least one side, which is adjacent the mold during the production process of the concrete shape, at least one groove extending along its entire length, into which fixing screws can be fitted at freely selected points, enabling the side of the sectional edge strip which has to be adjacent the mold to be fastened to the latter at least for the duration of the casting of the concrete shape.

It is frequently desirable to provide two grooves extending along the entire length of the sectional edge strip into which fixing screws can be screwed at angles, most frequently right angles, to each other at freely selectable points. These fixing screws hold the two sides of the sectional edge strip which are adjacent to the mold, for at least the duration of the concrete casting operation, to two parts of the mold disposed at the desired angle, most frequently right angle, to each other.

The cross-sectional geometry of the sectional edge strip can be made particularly simple by providing the groove, which takes the fixing screws, with grooved sidewalls, as known from the Swiss Patent Application No. 13 995/74 filed 10/19/74.

The accompanying drawing shows by way of example, a preferred form of embodiment of the sectional edge strip of the invention and its use, wherein.

Figure 3:
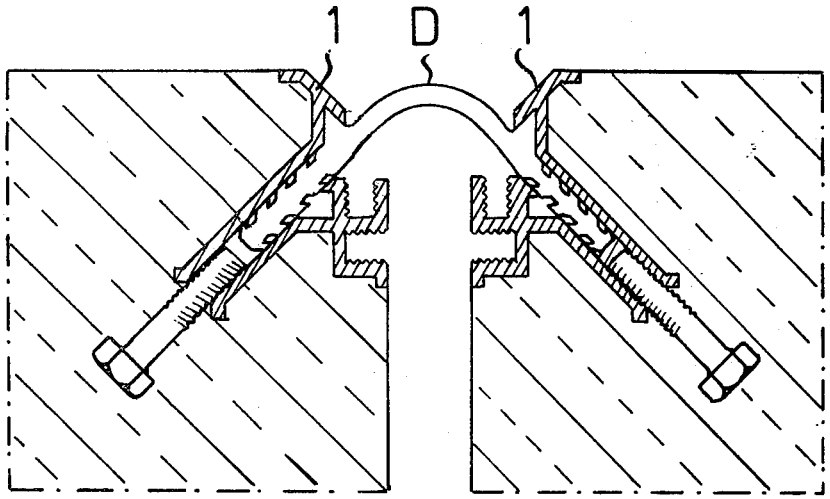
FIG. 3 is a partial sectional view of two concrete shapes with sectional edge strips and a jointing strip inserted therebetween.
Figure 1:
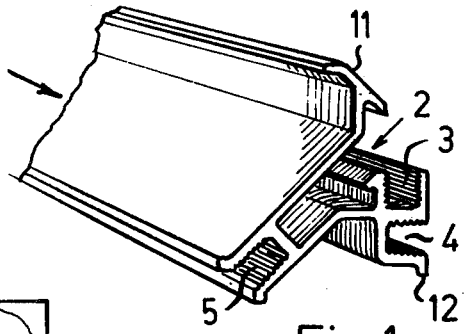
FIG. 1 shows a perspective view of a short length of the sectional edge strip of this invention.

Referring to the annexed drawing, the sectional edge strip designated with numeral 1 has a groove 2 adapted to take the edge of an elastic jointing strip, and two grooves with grooved sidewalls 3 and 4 for fixing the strip in the mold. Another groove 5 with grooved sidewalls serves to take anchor bolts. The centerlines of the two grooves 3 and 4 are at right angles to each other, while the common centerline of grooves 2 and 5 form an angle of 45° with the centerlines of the first two grooves, 3 and 4.

Figure 2:
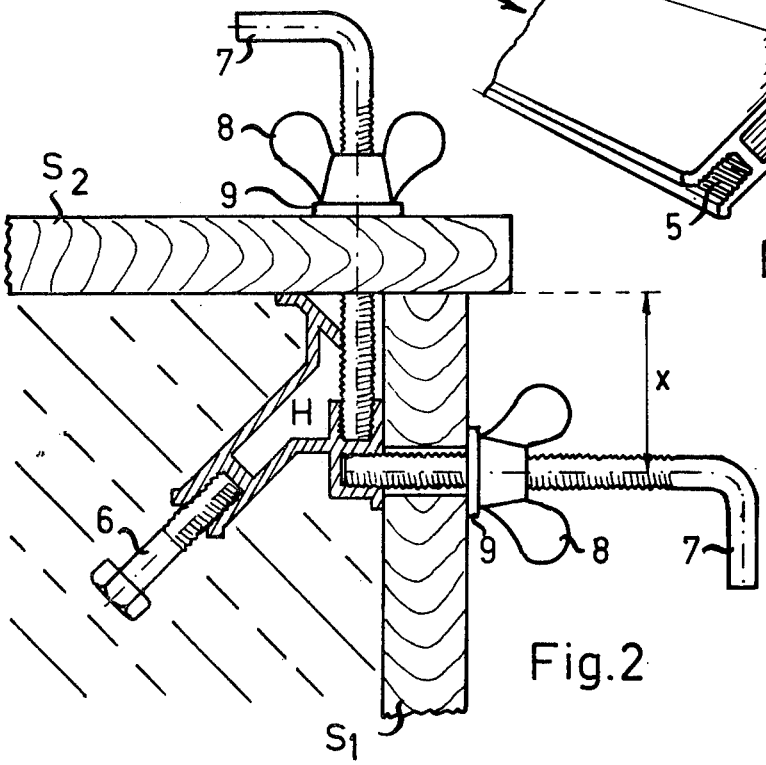
FIG. 2 shows a partial sectional view of the strip shown in FIG. 1 in position during the casting of a concrete shape.

Before the sectional edge strip is cast integrally in concrete, bolts 6 are fixed into groove 5 at certain intervals (see FIGS. 2 and 3) in order to anchor the strip in the concrete. Thereupon the strip thus prepared can be screwed onto the mold as shown in FIG. 2. For this a threaded pin 7 with its end bent over and a wing nut 8 can be used conveniently, with a washer 9.

Independent of the thickness of the mold $S_1$ and $S_2$ the threaded pin can be screwed to the bottom of the groove, whereupon the wing nut is tightened. It is of great advantage that the threaded pin can be screwed in at any point along groove 4, because this means that only the distance X from the edge must be maintained when making the holes in the mold part $S_1$. The distance between the individual holes is immaterial. The same applies to mold part $S_2$. If the edge faces 11, 12 make a good seal against the mold, there is no danger of cement or slurry getting into the hollow cavity H of the sectional edge strip. This is important in order to facilitate subsequent insertion of the elastic jointing strip D into groove 2, and to insure a good seal, as shown in FIG. 3.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. A sectional edge strip for casting integrally with a concrete shape comprising; a jointing strip groove adapted to take the edge of an elastic jointing strip, said edge strip having at least one side which is adjacent the mold during the production process of the concrete shape with two screw receiving grooves having their axes at right angles extending along its entire length into which fixing screws can be screwed at right angles to each other at freely selectable points, so that the two sides of the sectional edge strip which are to adjoin the mold can be, for at least the duration of the concrete casting operation, secured to two parts of the mold disposed at right angles to each other.

2. A sectional edge strip as defined in claim 1 wherein the grooves for the fixing screws are so disposed as to be covered by a jointing strip upon applying same.

3. A sectional edge strip as defined in claim 1 wherein at least the grooves for taking the fixing screws have grooved sidewalls, the grooved sidewalls corresponding with the profile of the nut thread of said screws.

4. A sectional edge strip as defined in claim 1 having a groove directed with its open side to the interior of the concrete shape to be produced, said groove extending along the entire length of the sectional strip and adapted to take anchor bolts screwable thereinto at freely selected points.

5. A sectional edge strip as defined in claim 1 wherein the centerline of the groove intended for taking the edge section of an elastic jointing strip is at substantially an angle of 45° with the two limiting faces of the concrete shape to be produced.

6. A sectional edge strip for casting integrally with a concrete shape at the juncture of two angular faces comprising; a jointing strip groove adapted to take the edge of an elastic jointing strip, two screw receiving grooves into which fixing screws can be fitted at freely selected points extending along the entire length of one side of said sectional edge strip which is adjacent the mold during the production process of the concrete shape so that both sides of the sectional edge strip which are to adjoin the mold can be, for at least the duration of the casting of the concrete shape, secured by said screws to two parts of the mold disposed at the desired angle to each other to form said angular faces.

7. A sectional edge strip as defined in claim 6 wherein the grooves for the fixing screws are so disposed as to be covered by a jointing strip upon applying same.

8. A sectional edge strip as defined in claim 6 wherein at least the groove intended for taking the fixing screws has grooved sidewalls, the grooved sidewalls corresponding with the profile of the nut thread of said screws.

9. A sectional edge strip as defined in claim 6 having a groove directed with its open side to the interior of the concrete shape to be produced, said groove extending along the entire length of the sectional strip and adapted to take anchor bolts screwable thereinto at freely selected points.

10. A sectional edge strip as defined in claim 6 wherein the centerline of the groove intended for taking the edge section of an elastic jointing strip is at substantially an angle of 45° with the two limiting faces of the concrete shape to be produced.

* * * * *